US011286616B2

(12) United States Patent
Na

(10) Patent No.: US 11,286,616 B2
(45) Date of Patent: Mar. 29, 2022

(54) SCREEN MACHINE FOR SCREENING FOR PAPER MATERIAL, CASING BODY FOR SCREEN MACHINE, AND SCREEN BASKET

(71) Applicant: Sung Ju Na, Incheon (KR)

(72) Inventor: Sung Ju Na, Incheon (KR)

( * ) Notice: Subject to any disclaimer, the term of this patent is extended or adjusted under 35 U.S.C. 154(b) by 485 days.

(21) Appl. No.: 16/473,595

(22) PCT Filed: Oct. 24, 2017

(86) PCT No.: PCT/KR2017/011752
§ 371 (c)(1),
(2) Date: Jun. 25, 2019

(87) PCT Pub. No.: WO2018/012443
PCT Pub. Date: Jul. 5, 2018

(65) Prior Publication Data

US 2020/0141058 A1 May 7, 2020

(30) Foreign Application Priority Data

Dec. 26, 2016 (KR) ..... 10-2016-0179562

(51) Int. Cl.
*D21D 5/02* (2006.01)
*B03B 5/56* (2006.01)

(52) U.S. Cl.
CPC ..... *D21D 5/023* (2013.01); *B03B 5/56* (2013.01)

(58) Field of Classification Search
CPC ..... D21D 5/02; D21D 5/023; D21D 5/06; D21D 5/12; B03B 5/56; B03B 5/626
(Continued)

(56) References Cited

U.S. PATENT DOCUMENTS 5,791,495 A * 8/1998 Gero ..... D21D 5/16 209/395
5,968,315 A * 10/1999 Meinander ..... D21F 1/66 162/55

(Continued)

FOREIGN PATENT DOCUMENTS

EP 0 473 354 A1 3/1992
EP 0 649 940 A1 4/1995

(Continued)

OTHER PUBLICATIONS

KR Office Action dated Mar. 2, 2017 as received in Application No. 10-2016-0179562.

(Continued)

*Primary Examiner* — Terrell H Matthews
(74) *Attorney, Agent, or Firm* — Maschoff Brennan

(57) ABSTRACT

A screen machine for resolving a raw material concentration phenomenon occurring in the screen machine, a casing body for the screen machine, and a screen basket. A diluent supplied through an external pipe enters a casing diluent pocket of a casing body. The diluent then enters a diluent supply path by passing through a diluent entrance of the screen basket through one or more casing diluent supply paths located in a casing upper flange and flows into a diluent pocket through a diluent exit of the screen basket by passing through the diluent supply path. The flowing diluent is sprayed onto a concentrated raw material through one or more open diluent spray holes formed on a spray surface of the diluent pocket. Since the concentrated raw material is diluted, the concentrated raw material can be lowered to a desired concentration, and problems of conventional screen machines can be resolved.

15 Claims, 9 Drawing Sheets

(58) Field of Classification Search
USPC ..... 209/270
See application file for complete search history.

(56) References Cited

U.S. PATENT DOCUMENTS

| | | | | |
|---|---|---|---|---|
| 6,080,274 | A * | 6/2000 | Hautala | D21D 5/02 162/55 |
| 6,171,448 | B1 | 1/2001 | Iwashige | |
| 7,121,411 | B2 * | 10/2006 | Aikawa | D21D 5/026 209/273 |
| 7,491,296 | B2 * | 2/2009 | Fredriksson | D21D 5/026 162/246 |

FOREIGN PATENT DOCUMENTS

| | | | | |
|---|---|---|---|---|
| EP | 0 795 641 | A1 | 9/1997 | |
| EP | 1 672 118 | A1 | 6/2006 | |
| EP | 1 882 773 | A1 | 1/2008 | |
| JP | H08-500636 | A | 1/1996 | |
| JP | 4361014 | B2 | 11/2009 | |
| JP | WO2012004887 | A1 * | 9/2013 | D21D 5/026 |
| KR | 10-1999-0072357 | A | 9/1999 | |
| KR | 10-0331376 | B1 | 4/2002 | |
| KR | 10-0815426 | B1 | 3/2008 | |
| WO | 93/23609 | A1 | 11/1993 | |
| WO | WO-9932712 | A1 * | 7/1999 | D21D 5/023 |

OTHER PUBLICATIONS

KR Decision of Grant dated Aug. 11, 2017 as received in Application No. 10-2016-0179562.

* cited by examiner

SCREEN MACHINE FOR SCREENING FOR PAPER MATERIAL, CASING BODY FOR SCREEN MACHINE, AND SCREEN BASKET

TECHNICAL FIELD

The present invention relates to a screening machine for screening a paper material, and a casing body and a screen basket included in the screening machine. More particularly, the present invention relates to a screening machine for screening a paper material capable of separating and screening a paper material into a high-quality acceptable raw material and a non-acceptable raw material including contaminants and defective raw materials, and a casing body and screen basket included in the screening machine.

BACKGROUND ART

To recycle waste paper as a paper material or to utilize pulp as a paper material, a screening process of separating contaminants and defective raw materials from a raw material is required.

A screening machine is one type of various screening machines for isolating contaminants and defective raw materials to separate an acceptable raw material from a non-acceptable raw material.

A screening machine is constituted of a casing body for receiving a paper material; a cover thereof; screen baskets fixed inside the casing body; screen rotors located inside or outside the screen basket; etc.

In addition, the casing body and the cover are equipped with a paper material inlet through which a paper material is input; an acceptable raw material outlet; a non-acceptable raw material outlet; and the like.

In addition, the screen rotors are equipped with various types of rotor blades for promoting screening efficiency according to a screening machine type and the purpose of screening a paper material.

A screening machine serves to screen a paper material in a manner wherein a raw paper material is supplied into a paper material inlet by the pressure of a pump, a high-quality acceptable raw material passes through open screen surfaces, which may be perforated in various shapes, of screen baskets by the centrifugal force due to rotation of screen rotors to be discharged through an acceptable raw material outlet, and a non-acceptable raw material including contaminants and defective raw materials is discharged through a non-acceptable raw material outlet.

Documents related to the present invention are as follows.

Korean Patent No. 10-0815426 (Mar. 20, 2008)

Korean Patent No. 10-0331376 (Apr. 3, 2002)

Korean Patent Application Publication No. 1989-7001836 (Dec. 5, 1988)

DISCLOSURE

Technical Problem

Therefore, the present invention has been made in view of the above problems, and it is one object of the present invention to provide a screening machine for screening a paper material which is capable of spraying a diluent to a raw material that is being concentrated, and a casing body and screen basket included in the screening machine.

It is another object of the present invention to provide a screening machine for screening a paper material which is capable of controlling a supply and spray location of a diluent, a spray amount and spray pressure of a diluent, and a method of spraying a diluent, and a casing body and screen basket included in the screening machine.

It is another object of the present invention to provide a screening machine for screening a paper material which is provided with a seal such that a supplied diluent is supplied and sprayed only to a concentrated raw material part that is being concentrated and does not leak and is not lost to other parts, and a casing body and screen basket included in the screening machine.

It is yet another object of the present invention to provide a screening machine for screening a paper material which allows efficient manufacture of a casing body with a diluent supply function and screen baskets serving to variously adjust a diluent supply and spray function, and a casing body and screen basket included in the screening machine.

Technical Solution

In accordance with one aspect of the present invention, provided is a screen basket having an open screen surface for screening a paper material on a circumferential surface thereof, the screen basket including a diluent pocket located on a circumferential surface of the screen basket and configured to have a space; a diluent inlet into which a diluent is introduced; a diluent outlet connected to the space of the diluent pocket; and a diluent supply passage through which the introduced diluent is introduced into a space of the diluent pocket, wherein the diluent pocket includes diluent spray holes for spraying the diluent, introduced into the space, inside or outside of the screen basket, one side of the diluent pocket is connected to the diluent outlet of the first screen basket flange, and an opposite side of the diluent pocket vertically elongates to the circumferential surface of the screen basket to be located at the second screen basket flange, so that the plurality of diluent spray holes are formed to be spaced from each other at different heights based on a position of the non-acceptable raw material outlet, and an open screen surface is formed at a position corresponding to the heights of the plurality of diluent spray holes.

The screen basket may include an upper screen basket flange assembled with an upper casing flange at an upper part of the circumferential surface. Here, the upper screen basket flange may include the diluent inlet, the diluent supply passage, and the diluent outlet.

The screen basket may include a lower screen basket flange assembled with a lower casing flange at a lower part of the circumferential surface. Here, the lower screen basket flange may include the diluent inlet, the diluent supply passage, and the diluent outlet.

The diluent pocket may be formed by welding a steel plate to a circumferential surface between an upper screen basket flange of the screen basket and a middle flange of the screen basket or by disposing a pipe at the circumferential surface.

The diluent pocket may be formed by welding a steel plate to a circumferential surface between a lower screen basket flange of the screen basket and a middle flange of the screen basket or by disposing a pipe at the circumferential surface.

The diluent pocket may be connected to the diluent outlet of the upper screen basket flange of the screen basket to vertically or horizontally elongate to the circumferential surface of the screen basket.

The diluent pocket may be connected to the diluent outlet of the lower screen basket flange of the screen basket to vertically or horizontally elongate to the circumferential surface of the screen basket.

According to the supply pressure and amount of the diluent, one or more diluent pockets may be included.

A diluent spray holes-formed surface may be formed at a surface of the diluent pocket located in a direction in which the diluent is sprayed, and the plurality of diluent spray holes may be formed at the diluent spray holes-formed surface. A plurality of diluent spray holes may be formed, depending upon supply pressure and amount of the diluent, at the diluent spray holes-formed surface, and positions of the diluent spray holes may be determined according to spray positions of the diluent. The plurality of diluent spray holes may be formed in at least one shape of a hole shape and a slot shape.

In accordance with another aspect of the present invention, there is provided a casing body for the screening machine having a screen basket embedded therein, wherein the casing body includes a diluent pocket having a space; a diluent inlet into which a diluent originating from the diluent pocket is introduced; a diluent outlet connected to the screen basket; and a diluent supply passage through which the introduced diluent is delivered to the screen basket flange.

At an upper part of the casing body for the screening machine, an upper casing flange coupled to an upper flange of the screen basket may be further included. Here, the upper casing flange may include the diluent inlet, the diluent supply passage, and the diluent outlet.

At a lower part of the casing body, a lower casing flange coupled to a lower flange of the screen basket may be further included. Here, the lower casing flange may include the diluent inlet, the diluent supply passage, and the diluent outlet.

The diluent pocket may be formed at a circumferential surface of an inside or outside of the casing body and the upper casing flange.

The diluent pocket may be formed at a circumferential surface of an inside or outside of the casing body and the lower casing flange.

In accordance with yet another aspect of the present invention, there is provided a screening machine including the screen basket according to the present invention and the casing body according to the present invention.

The screening machine may further include a sealing member for preventing leakage between the diluent outlet of the upper flange of the casing body and the diluent inlet, which is connected to the diluent outlet, of the upper flange of the screen basket.

The screening machine may further include a sealing member for preventing leakage between the diluent outlet of the lower flange of the casing body and the diluent inlet, which is connected to the diluent outlet, of the lower flange of the screen basket.

Advantageous Effects

As apparent from the fore-going, the present invention advantageously provides a screening machine for screening a paper material, and a casing body and a screen basket included in the screening machine. The casing body and the screen basket according to the present invention have a diluent supply function and a diluent spray function, thereby being capable of resolving a raw material concentration phenomenon occurring in a process of screening a raw paper material. The prevent invention can provide the following effects.

① A clogging phenomenon of an open screen surface of a screen basket due to a concentrated raw material can be resolved, so that the throughput efficiency of the open screen surface can increase. Accordingly, the throughput can greatly increase.

② The amount of a concentrated raw material can be greatly reduced, so that the energy required to discharge a concentrated raw material, which has not passed through an open screen surface, to a non-acceptable raw material outlet can be reduced. Accordingly, significant power saving can be achieved.

③ The phenomenon that contaminants are adsorbed to a high-quality acceptable raw material can be greatly reduced, so that an open screen surface throughput efficiency of an acceptable raw material can increase. Accordingly, the screening quality can increase.

④ Clogging of a non-acceptable raw material outlet due to a concentrated raw material can be prevented, so that the downtime of a screening machine can be shortened. Accordingly, the operation efficiency of the screening machine can increase.

⑤ Wear of a screen basket, a screen rotor, and rotor blades, which are key components of a screening machine, due to a concentrated raw material can be reduced, thereby preventing breakage thereof. Accordingly, the lifespan of the components can be prolonged.

⑥ Since the throughput of a first screening machine can be increased, the amount of a material discharged through a non-acceptable raw material outlet can be greatly reduced. Accordingly, an amount to be processed by second, third, and fourth screening machines used in subsequent re-processing processes can be reduced, thereby greatly reducing power.

⑦ Since the separation efficiency of an acceptable raw material from a non-acceptable raw material is high in the first screening machine, the screening quality by the second, third, and fourth screening machines can be increased.

⑧ Since the throughput of the screening machine is large, the dimensions of the screening machine can be reduced. Accordingly, an installation space of the screening machine can be reduced.

BEST MODE FOR CARRYING OUT THE INVENTION

Figure 1:
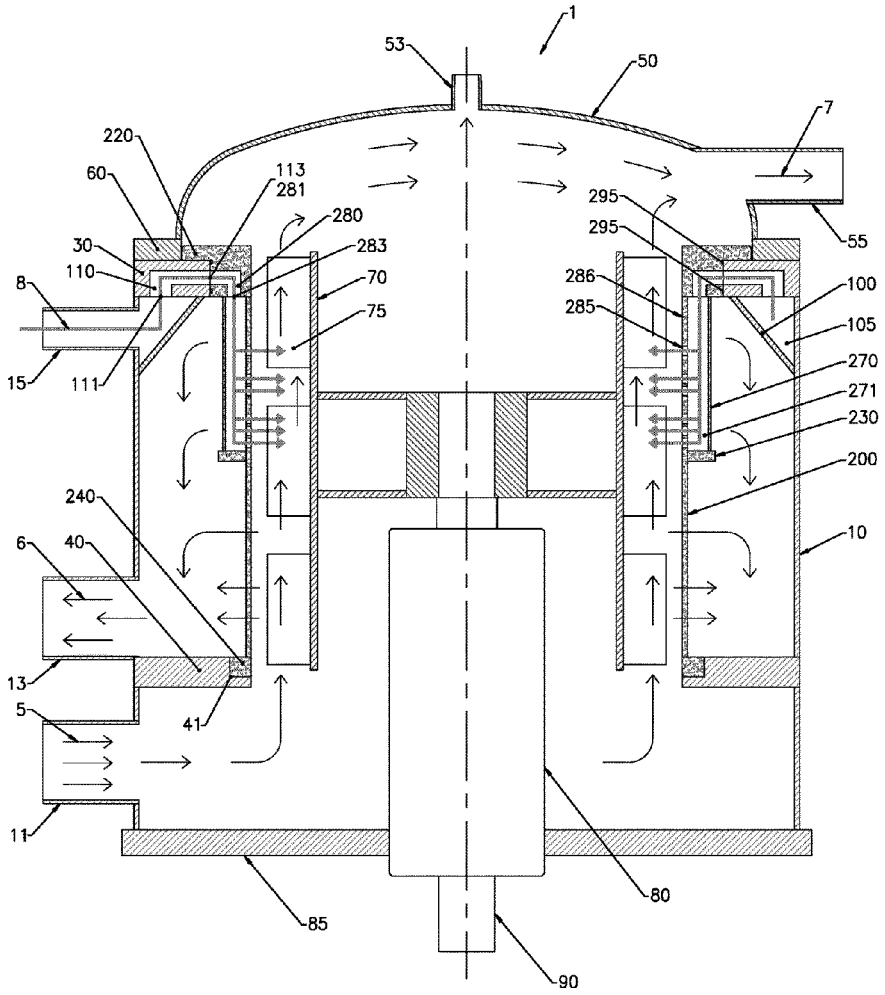
FIG. 1 schematically illustrates a vertical cross-sectional view of a screening machine for screening a paper material according to an embodiment of the present invention.

A screen basket according to the present invention has an open screen surface for screening a paper material on a circumferential surface thereof and includes a diluent pocket located on a circumferential surface of the screen basket and configured to have a space; a first screen basket flange located on one side of the circumferential surface and assembled with a casing flange adjacent to a non-acceptable raw material outlet of a casing body for the screening machine; a second screen basket flange located adjacent to the first screen basket flange; and a third screen basket flange located on another side of the circumferential surface, wherein the first screen basket flange includes a diluent inlet into which a diluent discharged from the casing flange is introduced; a diluent outlet connected to the space of the diluent pocket; and a diluent supply passage through which the introduced diluent is introduced into a space of the diluent pocket, and wherein the diluent pocket includes a plurality of diluent spray holes for spraying the diluent, introduced into the space, inside or outside of the screen basket, one side of the diluent pocket is connected to the diluent outlet of the first screen basket flange, and an opposite side of the diluent pocket vertically elongates to the circumferential surface of the screen basket to be located at the second screen basket flange, so that the plurality of diluent spray holes are formed to be spaced from each other at different heights based on a position of the non-acceptable raw material outlet, and an open screen surface is formed at a position corresponding to the heights of the plurality of diluent spray holes. The screen basket may include one or more diluent pockets according to the supply pressure and amount of the diluent. The first screen basket flange may be an upper screen basket flange or a lower screen basket flange. The diluent pocket may be manufactured by welding a steel plate or a pipe to a circumferential surface between the first screen basket flange and the second screen basket flange. A diluent spray holes-formed surface may be formed at a surface of the diluent pocket located in a direction in which the diluent is sprayed, and the plurality of diluent spray holes may be formed at the diluent spray holes-formed surface. A plurality of diluent spray holes may be formed, depending upon supply pressure and amount of the diluent, at the diluent spray holes-formed surface, and positions of the diluent spray holes may be determined according to spray positions of the diluent. The plurality of diluent spray holes may be formed in at least one shape of a hole shape and a slot shape.

A casing body for the screening machine according to the present invention is provided with a screen basket embedded therein and includes a diluent pocket having a space that is configured to store a diluent introduced from the outside of the diluent pocket; a non-acceptable raw material outlet configured to discharge a non-acceptable raw material that does not pass through an open screen surface of the screen basket; and a first casing flange located adjacent to the non-acceptable raw material outlet and coupled with a screen basket flange of the screen basket, wherein the first casing flange includes a diluent inlet into which a diluent originating from the diluent pocket is introduced; a diluent outlet connected to the screen basket; and a diluent supply passage through which the introduced diluent is delivered to the screen basket flange, wherein the space of the diluent pocket is located at a lower part of the diluent inlet, and wherein a loop is formed along the first casing flange. The first casing flange may be an upper casing flange or a lower casing flange. The diluent pocket may be formed at a circumferential surface of an inside or outside of the casing body and the first casing flange.

A screening machine according to the present invention may include the screen basket and the casing body according to the present invention. The screening machine may further include a sealing member for preventing leakage between the diluent outlet of the first casing flange of the casing body and the diluent inlet, connected to the diluent outlet, of the first screen basket flange of the screen basket. The diluent supply passage formed at the first screen basket flange of the screen basket may be horizontally connected to the diluent supply passage formed at the first casing flange of the casing body.

MODE FOR CARRYING OUT THE INVENTION

Hereinafter, a screening machine for screening a paper material, a casing body for the screening machine, and a screen basket according to the present invention will be explained in detail with reference to the attached drawings. Here, the constructions and operations of the present invention shown in and described by the drawings are illustrated as at least one embodiment, whereby the technical idea of the present invention and core constructions and operations thereof are not limited to the embodiment.

Most of the terms used herein are general terms that have been widely used in the technical art to which the present invention pertains. However, some of the terms used herein may be created reflecting intentions of technicians in this art, precedents, or new technologies. Also, some of the terms used herein may be arbitrarily chosen by the present applicant. In this case, these terms are defined in detail below. Accordingly, the specific terms used herein should be understood based on the unique meanings thereof and the whole context of the present invention.

A high-quality acceptable raw material of a paper material containing a large amount of water rapidly passes through an open screen surface of the screen basket from a paper material inlet, along with water, in a process of screening the paper material.

Here, since water passes through the open screen surface of the screen basket more easily and rapidly than the high-quality acceptable raw material, a high-quality acceptable raw material that has not passed through the open screen surface is concentrated while being mixed with a non-acceptable raw material including contaminants and defective raw materials.

Such a concentration phenomenon worsens as the paper material approaches a non-acceptable raw material outlet because the amount of a raw material that has not passed through the open screen surface continuously increases and the amount of water contained therein is reduced as the paper material approaches the non-acceptable raw material outlet. Accordingly, the concentration of the mixed raw material further increases, which results in the following problems.

① Although a high-quality acceptable raw material occupies 80% or more of a concentrated raw material, the efficiency of passing through the open screen surface is rapidly reduced due to the concentration phenomenon. Accordingly, a large amount of the high-quality acceptable raw material is discharged through the non-acceptable raw material outlet, which results in a reduction in the throughput.

② To discharge the concentrated raw material through the non-acceptable raw material outlet, a large amount of energy is necessary in proportion to the concentration and the concentrated amount. Accordingly, additional power consumption is very large.

③ The high-quality acceptable raw material in the concentrated raw material is adsorbed to contaminants, and, in the absorbed state, passes through the open screen surface of the screen basket, which results in substantial deterioration in the screening quality.

④ The concentrated raw material often causes clogging of the non-acceptable raw material outlet in a process of being discharged through the non-acceptable raw material, which greatly lowers the operation efficiency of a screening machine.

⑤ The concentrated raw material rapidly wears surfaces of the screen basket, a screen rotor, and rotor blades, as key components of a screening machine, thus causing lifespan reduction and breakage thereof.

⑥ Since the high-quality acceptable raw material occupies 80% or more of the concentrated raw material that has been discharged, a re-processing process should be performed once to three times using a subsequent screening machine so as to perform re-separation of the concentrated raw material.

In the re-processing process, the problems of ① to ⑤ are repeated while further deteriorating screening environments. Accordingly, the power consumption in subsequent screening machines further increases and the screening quality thereby is further decreased.

A screening machine for screening a paper material according to the present invention and a casing body and a screen basket included in the screening machine can prevent a raw material from being concentrated and, when the concentration of a paper material is maintained similarly to an initial concentration thereof, can address the above problems.

The screening machine for screening a paper material according to the present invention and the casing body and the screen basket included in the screening machine may be manufactured as follows.

A casing diluent pocket is provided with a diluent pocket space with an appropriate volume according to the supply pressure and amount of a diluent using the casing body and an upper part of a casing or a lower flange.

Here, the diluent pocket space is integrally formed such that supply passages are located inside the casing body along a circumferential and cylindrical surface of the casing body so as to freely vary the number, sizes, and positions of the diluent supply passages.

Casing diluent supply passages are provided at an upper part of the casing or the lower flange considering a number, sizes, and positions necessary for a diluent to enter the screen basket.

Screen basket diluent supply passages are provided at an upper part of the screen basket or the lower flange to correspond to the number, sizes, and positions of the casing diluent supply passages.

Here, connections parts, e.g., a flange part of the casing or a flange part of the screen basket, between the casing diluent supply passages and the screen basket diluent supply passages should be provided with a seal such as an O-ring or a packing so as to prevent leakage of a supplied diluent to other parts.

Screen basket diluent pockets are provided with a diluent pocket space with an appropriate volume according to the supply pressure and amount of a diluent and the number, sizes, and positions of the diluent supply passages using an upper part of the screen basket or a lower flange, a middle flange, and a circumferential and cylindrical surface of the screen basket.

Screen basket diluent spray holes are provided at a diluent spray holes-formed surface depending upon positions at which a diluent is to be supplied.

Here, one or more diluent spray holes may be manufactured according to the supply pressure, supply amount, and supply positions of a diluent to be sprayed, and the shapes of the diluent spray holes may be varied according to purposes.

FIG. 1 schematically illustrates a vertical cross-sectional view of a screening machine for screening a paper material according to an embodiment of the present invention. FIG. 1 is a vertical cross-sectional view schematically illustrating a screening machine 1 according to an embodiment of the present invention including a casing body 10, and screen baskets 200 and screen rotors 70 coupled to the casing body 10, and exhibiting streams of a raw paper material 5 and a diluent 8 in the screening machine 1. The screening machine 1 performs screening in a manner wherein the raw paper material 5 enters from a lower part of a lower casing flange 40 of the screening machine 1, the diluent 8 enters through an upper casing flange 30 of the screening machine 1, and a non-acceptable raw material 7 is discharged to an upper part of the casing body 10.

Figure 2:
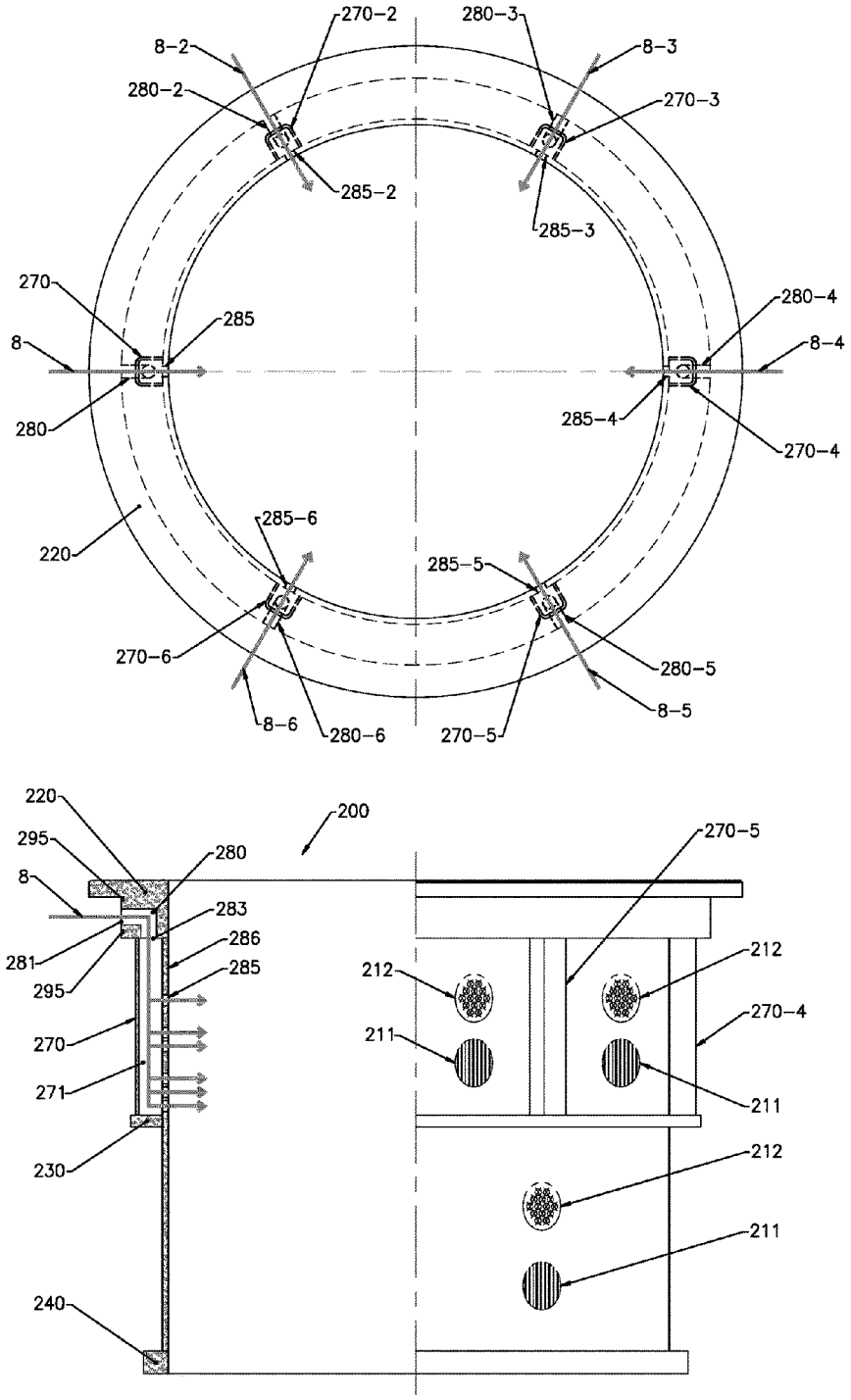
FIG. 2 schematically illustrates a vertical cross-sectional view and an outside view of a screen basket according to an embodiment of the present invention.

FIG. 2 schematically illustrates a vertical cross-sectional view and an outside view of a screen basket according to an embodiment of the present invention. FIG. 2 is a set of a vertical cross-sectional view and an outside view schematically illustrating the structure of a screen basket according to an embodiment of the present invention and steams of a diluent 8 in the screen basket. Particularly, FIG. 2 schematically illustrates that the diluent 8 enters from an upper screen basket flange 220 and is sprayed through diluent spray holes 285.

Referring to FIGS. 1 and 2, the screening machine 1 according to the present invention includes the casing body 10, upper casing flanges 30, lower casing flanges 40, a casing bottom base 85, casing diluent pockets 100, a casing diluent supply passage 110, screen baskets 200, a cover 50, cover flanges 60, screen rotors 70, rotor blades 75, a bearing housing 80, and a shaft 90.

In the casing body 10, the screen baskets 200, the screen rotors 70, the rotor blades 75, and the bearing housing 80, and the shaft 90 may be embedded. In addition, the casing body 10 may be provided with a paper material inlet 11 through which a paper material 5 is introduced, an acceptable raw material outlet 13 through which an acceptable raw material 6 is discharged, and a diluent supply inlet 15 through which the diluent 8 is introduced. Further, the casing body 10 may include the upper casing flanges 30, the lower casing flanges 40, and the diluent pockets 100. As needed, the casing body 10 may include a non-acceptable raw material outlet 55 through which the non-acceptable raw material 7 is discharged.

Each of the upper casing flanges 30 is provided with one or more diluent inlets 111, diluent supply passages 110, and casing diluent outlets 113, and is coupled with the upper screen basket flange 220 and the cover flanges 60.

The positions and number of the casing diluent outlets 113 are provided to coincide with the directions and number of the screen basket diluent inlets 281.

Each of the lower casing flanges 40 may be provided with a lower casing flange groove 41 to couple with a lower screen basket flange 240.

Each of the casing diluent pockets 100 may be manufactured by welding a steel plate or a pipe to a circumferential and cylindrical surface of the casing body 10 to elongate in a circumferential and cylindrical surface direction of the casing body 10. In addition, each of the casing diluent pockets 100 may be provided with a casing diluent pocket space 105 in which the diluent 8 introduced through the diluent supply inlet 15 is contained.

The size of each of the casing diluent pockets 100 may be determined according to the supply pressure and supply amount of the diluent 8. In addition, each of the casing diluent pockets 100 may be provided inside or outside the casing body 10. It should be understood that the shape and type of each of the casing diluent pockets 100 is not limited to the embodiments illustrated in the drawings and may be variously modified.

Each of the screen baskets 200 is embedded in the screening machine 1 and is constituted of an upper flange 220, a middle flange 230, a lower flange 240, a diluent pocket 270, diluent spray holes 285, a sealing member such as the O-ring 295, and the like. In addition, a circumferential and cylindrical surface of each of the screen baskets 200 is provided with an open screen surface 211 or 212.

With regard to the open screen surface 211 or 212, a slots-formed open surface 211, a holes-formed open surface 212, or a combination thereof may be provided according to the purpose of screening a paper material.

The upper screen basket flange 220 may be provided with one or more diluent inlets 281, diluent supply passages 280 to 280-6, and diluent outlets 283, and couple with the upper casing flanges 30.

The positions and number of the screen basket diluent inlets 281 are provided to coincide with the directions and number of the casing diluent outlets 113.

The lower screen basket flange 240 may be seated on and coupled with the lower casing flange groove 41 of the lower casing flange 40.

The screen basket diluent pocket 270 may be formed by welding a steel plate or a pipe to a circumferential and cylindrical surface of the screen baskets 200 to elongate in a circumferential and cylindrical surface direction of the screen baskets 200 using the upper screen basket flange 220 and the middle screen basket flange 230. In addition, the screen basket diluent pocket 270 may be provided with a screen basket diluent pocket space 271 in which the diluent introduced through a diluent supply passage 280 is contained.

The sizes, number, and positions of screen basket diluent pockets 270 to 270-6 are determined by the supply pressures, supply amounts, and supply positions of diluents 8 to 8-6. In addition, the diluent spray holes-formed surface 286, which may be provided with diluent spray holes 285 to 285-6, is provided in directions and at positions where the diluents 8 to 8-6 are to be sprayed.

The diluent spray holes 285 of each of the screen baskets 200 may be formed in various shapes in the diluent spray holes-formed surface 286 according to the purpose of spraying the diluent 8.

A surface on which the screen basket diluent inlet 281 of each of the screen baskets 200 is coupled with each of the casing diluent outlets 113 should be sealed by a sealing member such as the O-ring 295 so as to prevent leakage of the diluent 8. Here, the sealing member such as the O-ring 295 may be located at the upper casing flange 30 or the upper screen basket flange 220.

The cover 50 includes the cover flanges 60; a multi-purpose pipe 53; and the non-acceptable raw material outlet 55 through which the non-acceptable raw material 7 is discharged. Here, the cover flanges 60 are coupled with and fixed to the upper casing flanges 30.

The multi-purpose pipe 53 may serve to discharge contaminants having low specific gravity and may be used to supplement the diluent 8.

Each of the screen rotors 70 is equipped with various types of rotor blades 75 for promoting screening efficiency according to the purpose of screening a paper material, and is coupled with the shaft 90 to rotate according to rotation of the shaft 90.

The bearing housing 80 surrounds the outside of a bearing, coupled with the shaft 90, and a portion of the shaft 90, and is coupled with and fixed to the casing bottom base 85.

One side of the shaft 90 is coupled with the screen rotors 70, and an opposite side thereof is connected to a rotating apparatus that is connected to a motor (not shown) to rotate according to the rotational force of the motor.

Figure 3A:
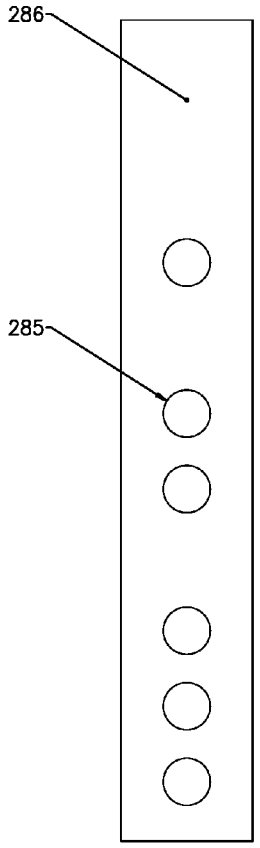
FIGS. 3*a* to 3*c* illustrate embodiments of open diluent spray holes formed in a diluent spray holes-formed surface of a screen basket according to an embodiment of the present invention.
Figure 3B:
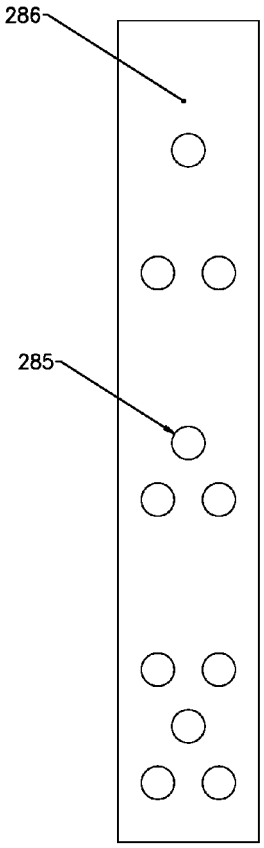
Figure 3C:
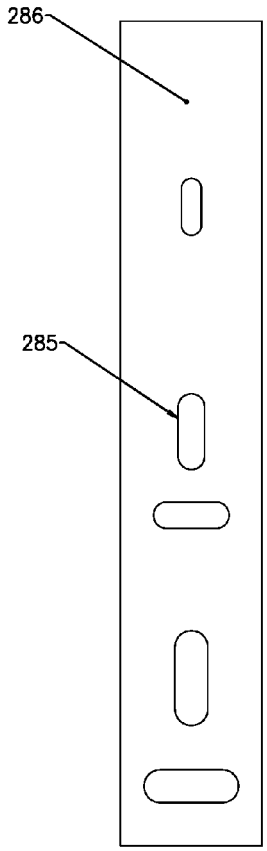

FIGS. 3*a* to 3*c* illustrate embodiments of open diluent spray holes formed in a diluent spray holes-formed surface of a screen basket according to an embodiment of the present invention. FIGS. 3*a* to 3*c* illustrate embodiments of open diluent spray holes 285 with various shapes formed in a diluent spray holes-formed surface 286 of the screen basket according to an embodiment of the present invention.

Referring to FIGS. 3*a* to 3*c*, the screen basket diluent spray holes 285 may be manufactured in shapes such as (a), (b), and (c) according to the supply pressure, supply amount, and spray positions of the diluent 8. The positions, number, types, and shapes of the diluent spray holes 285 are not limited to embodiments illustrated in the drawings and may be variously modified and combined.

Figure 4:
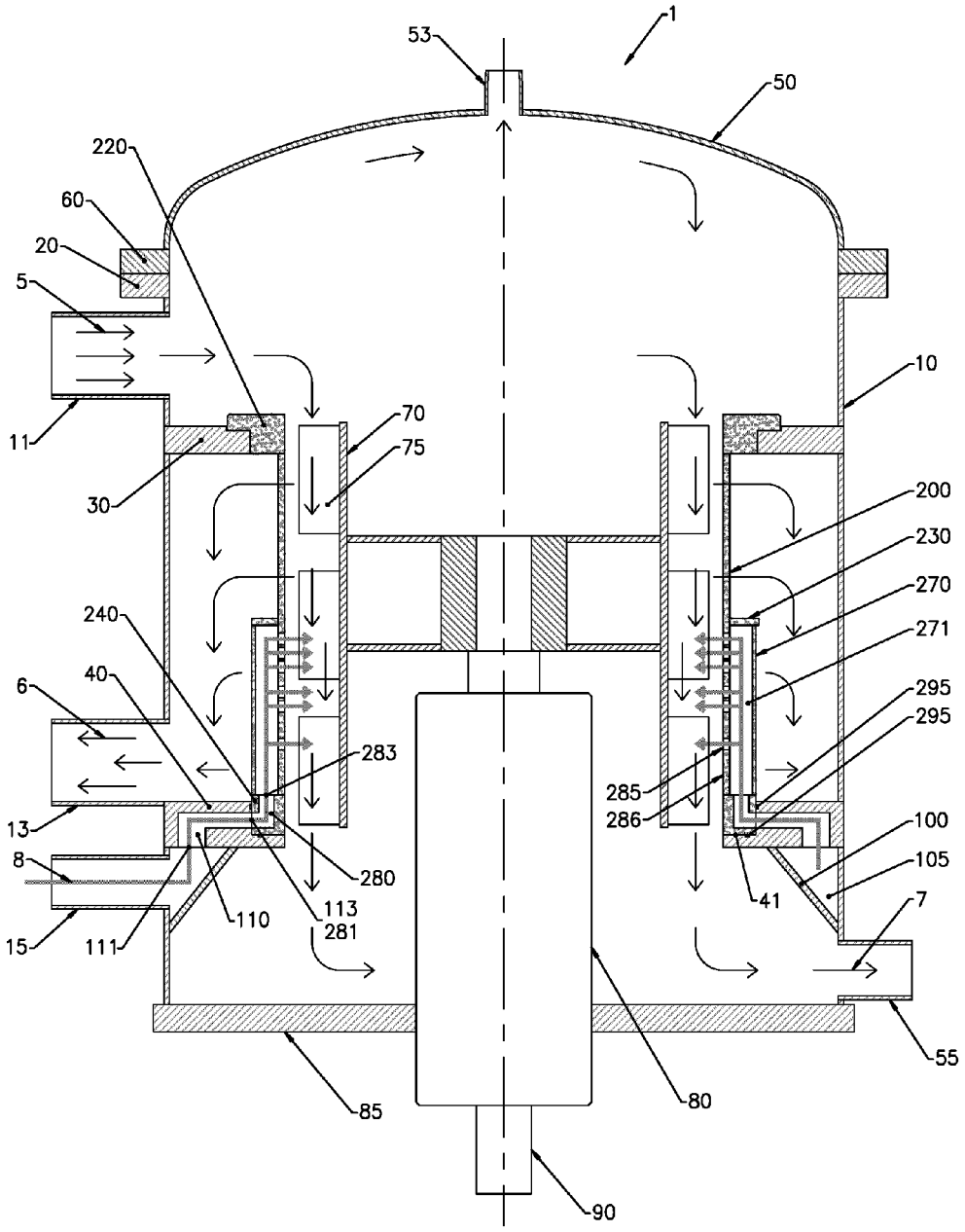
FIG. 4 schematically illustrates a vertical cross-sectional view of a screening machine for screening a paper material according to another embodiment of the present invention.

FIG. 4 schematically illustrates a vertical cross-sectional view of a screening machine for screening a paper material according to another embodiment of the present invention. FIG. 4 is a vertical cross-sectional view schematically illustrating a screening machine 1 according to another embodiment of the present invention including a casing body 10, and screen baskets 200 and screen rotors 70 coupled to the casing body 10, and exhibiting streams of a raw paper material 5 and a diluent 8 in the screening machine 1. The screening machine 1 performs screening in a manner wherein the raw paper material 5 enter from an upper part of an upper casing flange 30 of the screening machine 1, the diluent 8 enters through a lower casing flange 40 of the screening machine 1, and a non-acceptable raw material 7 is discharged to a lower part of the casing body 10.

Figure 5:
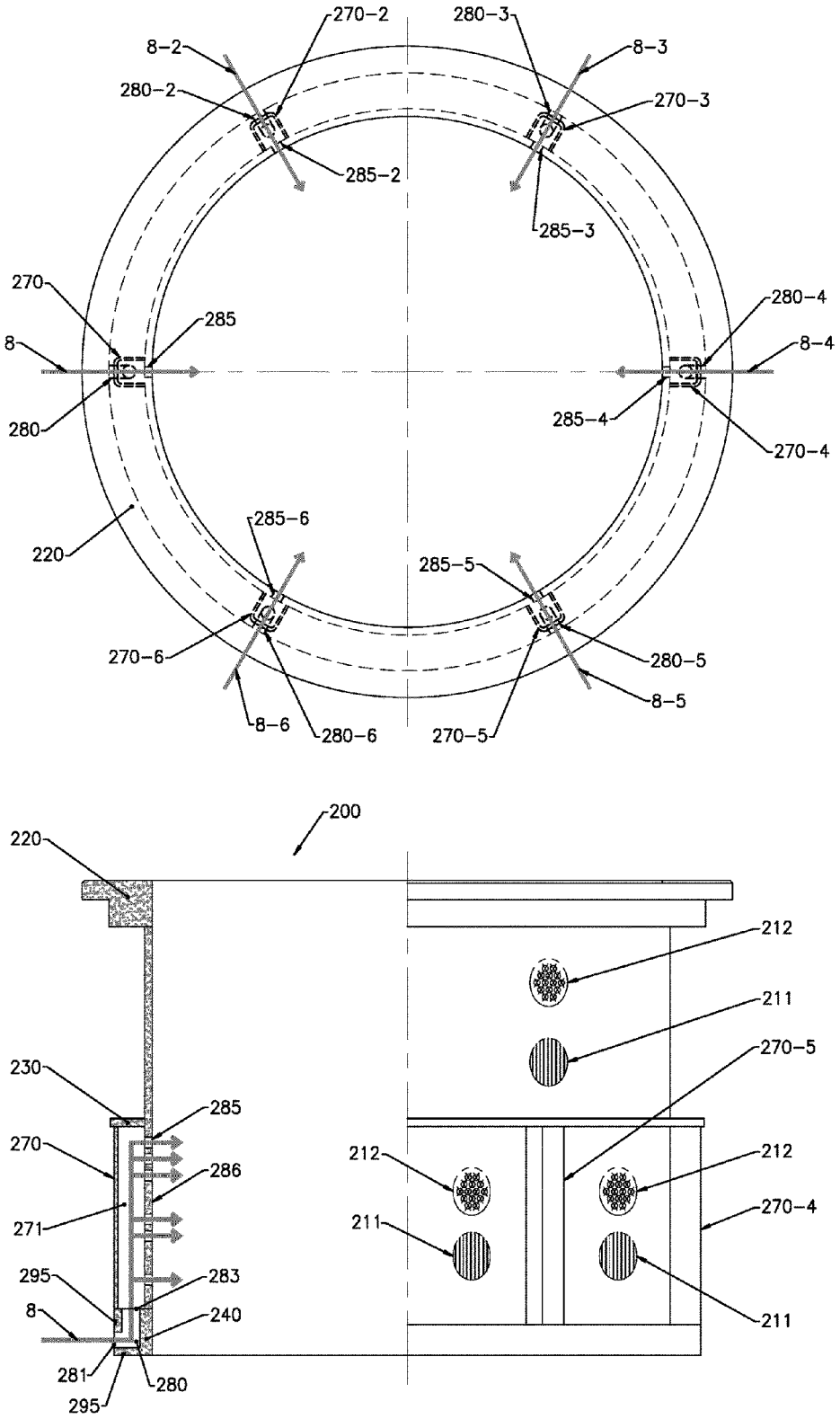
FIG. 5 schematically illustrates a vertical cross-sectional view and an outside view of a screen basket according to another embodiment of the present invention.

FIG. 5 schematically illustrates a vertical cross-sectional view and an outside view of a screen basket according to another embodiment of the present invention. FIG. 5 is a set of a vertical cross-sectional view and an outside view schematically illustrating the structure of a screen basket according to another embodiment of the present invention and steams of a diluent 8 in the screen basket. Particularly, FIG. 5 schematically illustrates that the diluent 8 enters from a lower screen basket flange 240 and is sprayed through diluent spray holes 285.

Referring to FIGS. 4 and 5, the screening machine 1 according to the present invention includes the casing body 10, casing cover flanges 20, upper casing flanges 30, lower casing flanges 40, a casing bottom base 85, casing diluent pockets 100, a casing diluent supply passage 110, screen baskets 200, a cover 50, cover flanges 60, screen rotors 70, rotor blades 75, a bearing housing 80, and a shaft 90.

In the casing body 10, the screen baskets 200, the screen rotors 70, the rotor blades 75, and the bearing housing 80, and the shaft 90 may be embedded. In addition, the casing body 10 may be provided with a paper material inlet 11 through which a paper material 5 is introduced, an acceptable raw material outlet 13 through which an acceptable raw material 6 is discharged, and a diluent supply inlet 15 through the diluent 8 is introduced. Further, the casing body 10 may include the upper casing flanges 30, the lower casing flanges 40, the diluent pockets 100, and a non-acceptable raw material outlet 55 through which the non-acceptable raw material 7 is discharged.

Each of the lower casing flanges 40 is provided with one or more diluent inlets 111, diluent supply passages 110, and casing diluent outlets 113. In addition, the lower screen basket flange 240 may be seated on and coupled with a lower flange groove 41 of each of the lower casing flanges 40.

The positions and number of the casing diluent outlets 113 are provided to coincide with the directions and number of the screen basket diluent inlets 281.

Each of the lower casing flanges 40 may be provided with a lower casing flange groove 41 to couple with a lower screen basket flange 240.

Each of the casing diluent pockets 100 may be manufactured by welding a steel plate or a pipe to a circumferential and cylindrical surface of the casing body 10 to elongate in a circumferential and cylindrical surface direction of the casing body 10. In addition, each of the casing diluent pockets 100 may be provided with a casing diluent pocket space 105 in which the diluent 8 introduced through the diluent supply inlet 15 is contained.

The size of each of the casing diluent pockets 100 may be determined according to the supply pressure and supply amount of the diluent 8. In addition, each of the casing diluent pockets 100 may be provided inside or outside the casing body 10. It should be understood that the shape and type of each of the casing diluent pockets 100 is not limited to the embodiments illustrated in the drawings and may be variously modified.

Each of the screen baskets 200 is embedded in the screening machine 1 and is constituted of an upper flange 220, a middle flange 230, a lower flange 240, a diluent pocket 270, diluent spray holes 285, a sealing member such as the O-ring 295, and the like. In addition, a circumferential and cylindrical surface of each of the screen baskets 200 is provided with an open screen surface 211 or 212.

With regard to the open screen surface 211 or 212, a slots-formed open surface 211, a holes-formed open surface 212, or a combination thereof may be provided according to the purpose of screening a paper material.

The lower screen basket flange 240 may be provided with one or more diluent inlets 281, diluent supply passages 280 to 280-6, and diluent outlets 283, and may be seated on and coupled with the lower casing flange groove 41.

The positions and number of the screen basket diluent inlets 281 are provided to coincide with the directions and number of the casing diluent outlets 113.

The lower screen basket flange 240 may be seated on and coupled with the lower casing flange groove 41 of the lower casing flange 40.

The screen basket diluent pocket 270 may be formed by welding a steel plate or a pipe to a circumferential and cylindrical surface of the screen baskets 200 to elongate in a circumferential and cylindrical surface direction of the screen baskets 200 using the lower screen basket flange 240 and the middle screen basket flange 230. In addition, the screen basket diluent pocket 270 may be provided with a screen basket diluent pocket space 271 in which the diluent introduced through a diluent supply passage 280 is contained.

The sizes, number, and positions of screen basket diluent pockets 270 to 270-6 are determined by the supply pressures, supply amounts, and supply positions of diluents 8 to 8-6. In addition, the diluent spray holes-formed surface 286, which may be provided with diluent spray holes 285 to 285-6, is provided in directions and at positions where the diluents 8 to 8-6 are to be sprayed.

The diluent spray holes 285 of each of the screen baskets 200 may be formed in various shapes in the diluent spray holes-formed surface 286 according to the purpose of spraying the diluent 8.

A surface on which the screen basket diluent inlet 281 of each of the screen baskets 200 is coupled with each of the casing diluent outlets 113 should be sealed by a sealing member such as the O-ring 295 so as to prevent leakage of the diluent 8. Here, the sealing member such as the O-ring 295 may be located at the lower casing flange 40 or the lower screen basket flange 240.

The cover 50 includes the cover flanges 60 and a multi-purpose pipe 53. Here, the cover flanges 60 are coupled with and fixed to the upper casing flanges 30.

The multi-purpose pipe 53 may serve to discharge contaminants having low specific gravity and may be used to supplement the diluent 8.

Each of the screen rotors 70 is equipped with various types of rotor blades 75 for promoting screening efficiency according to the purpose of screening a paper material, and is coupled with the shaft 90 to rotate according to rotation of the shaft 90.

The bearing housing 80 surrounds the outside of a bearing, coupled with the shaft 90, and a portion of the shaft 90, and is coupled with and fixed to the casing bottom base 85.

One side of the shaft 90 is coupled with the screen rotors 70, and an opposite side thereof is connected to a rotating apparatus that is connected to a motor (not shown) to rotate according to the rotational force of the motor.

Figure 6:
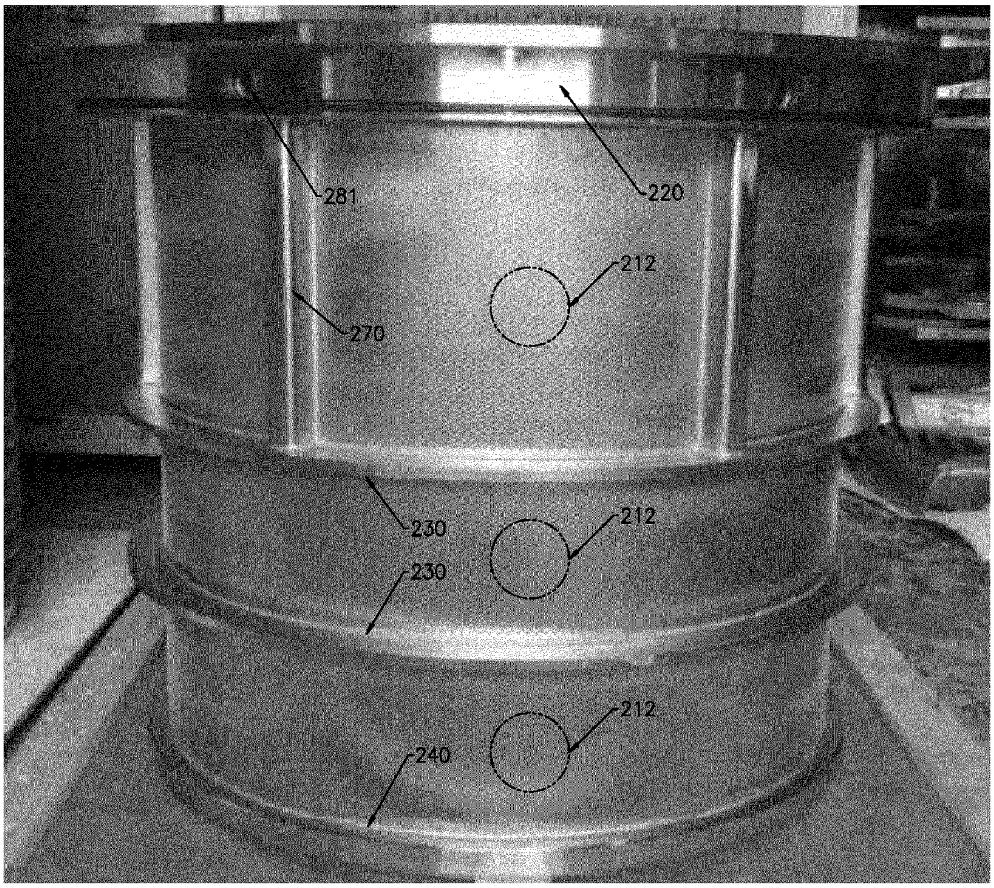
FIG. 6 illustrates a photograph of an outer front surface of a screen basket according to an embodiment of the present invention.

FIG. 6 illustrates a photograph of an outer front surface of a screen basket 200 according to an embodiment of the present invention.

From the photograph of FIG. 6, it can be confirmed that the screen basket 200 includes an upper screen basket flange 220, a middle screen basket flange 230, a lower screen basket flange 240, diluent pockets 270, screen basket diluent inlets 281, and an open screen surface 212 with holes formed on a circumferential and cylindrical surface of the screen basket 200.

Figure 7:
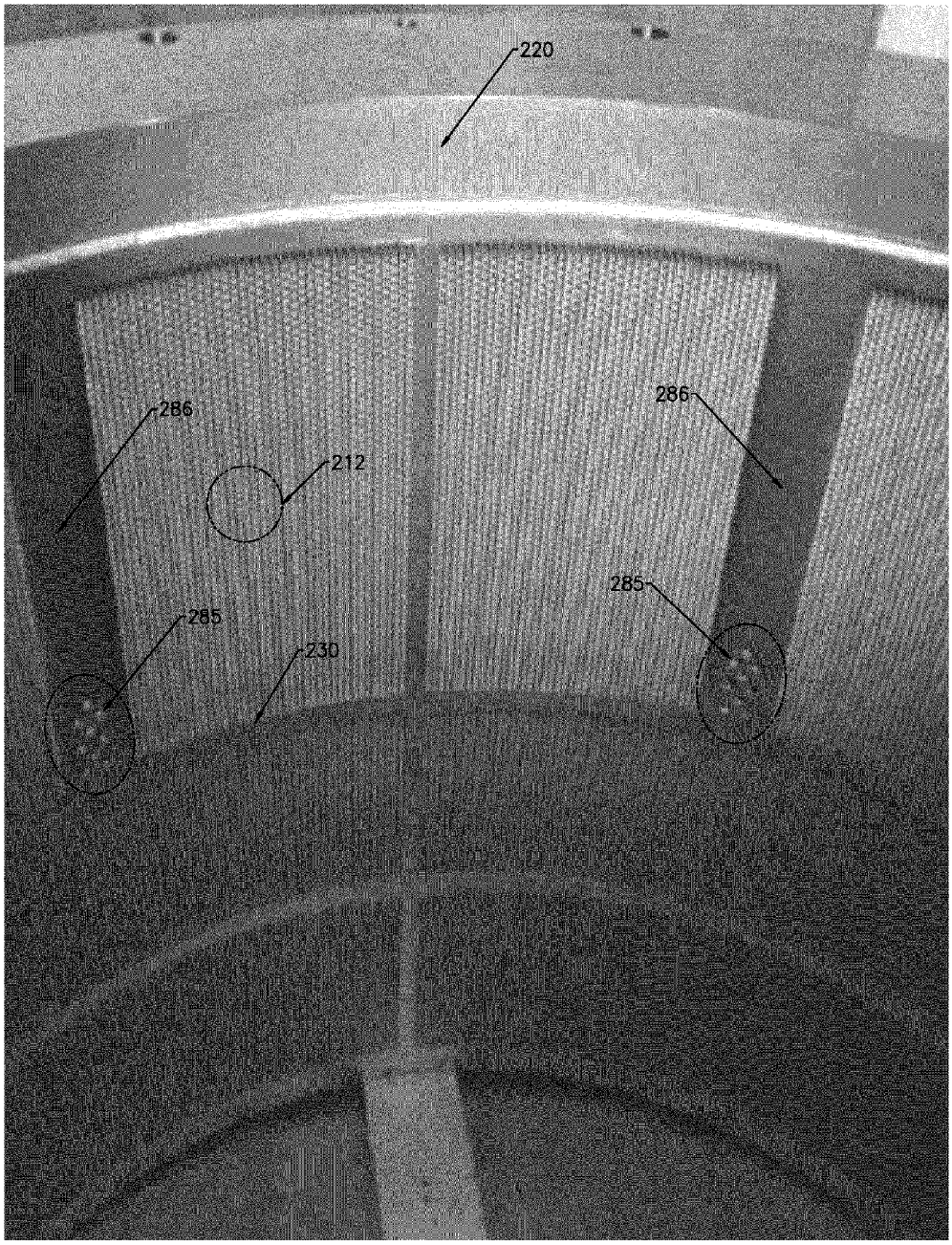
FIG. 7 illustrates a photograph of an inner front surface of a screen basket according to an embodiment of the present invention.

FIG. 7 illustrates a photograph of an inner front surface of a screen basket 200 according to an embodiment of the present invention.

From the photograph of FIG. 7, it can be confirmed that the screen basket 200 includes an upper screen basket flange 220, a middle screen basket flange 230, diluent spray holes-formed screen basket surfaces 286, screen basket diluent spray holes 285, and an open screen surface 212 with holes formed on a circumferential and cylindrical surface of the screen baskets 200.

Although the present invention has been described in detail with reference to the preferred embodiments, those skilled in the art will appreciate that the scope of the present invention is not limited to the embodiments, various changes and modifications are possible without departing from the spirit and scope of the invention as defined by the appended claims, and the changes and the modifications are included in the scope of the present invention.

INDUSTRIAL APPLICABILITY

The present invention can be used in the field of paper manufacturing.

The invention claimed is:

1. A screen basket having an open screen surface for screening a paper material on a circumferential surface thereof, the screen basket comprising:

a diluent pocket located on a circumferential surface of the screen basket and configured to have a space;

a first screen basket flange located on one side of the circumferential surface and assembled with a casing flange adjacent to a non-acceptable raw material outlet of a casing body for a screening machine;

a second screen basket flange located adjacent to the first screen basket flange; and a third screen basket flange located on another side of the circumferential surface, wherein the first screen basket flange comprises a diluent inlet into which a diluent discharged from the casing flange is introduced; a diluent outlet connected to the space of the diluent pocket; and a diluent supply passage through which the introduced diluent is introduced into a space of the diluent pocket, and wherein the diluent pocket comprises a plurality of diluent spray holes for spraying the diluent, introduced into the space, inside or outside of the screen basket, one side of the diluent pocket is connected to the diluent outlet of the first screen basket flange, and an opposite side of the diluent pocket vertically elongates to the circumferential surface of the screen basket to be located at the second screen basket flange, so that the plurality of diluent spray holes are formed to be spaced from each other at different heights based on a position of the non-acceptable raw material outlet, and an open screen surface is formed at a position corresponding to the heights of the plurality of diluent spray holes.

2. The screen basket according to claim 1, comprising one or more diluent pockets depending on supply pressure and supply amount of a diluent.

3. The screen basket according to claim 1, wherein the first screen basket flange is an upper screen basket flange or a lower screen basket flange.

4. The screen basket according to claim 1, wherein the diluent pocket is manufactured by welding a steel plate or a pipe to a circumferential surface between the first screen basket flange and the second screen basket flange.

5. The screen basket according to claim 1, wherein a diluent spray holes-formed surface is formed at a surface of the diluent pocket located in a direction in which the diluent is sprayed, and the plurality of diluent spray holes are formed at the diluent spray holes-formed surface.

6. The screen basket according to claim 5, wherein a plurality of diluent spray holes is formed, depending upon supply pressure and amount of the diluent, at the diluent spray holes-formed surface, and positions of the diluent spray holes are determined depending on spray positions of the diluent.

7. The screen basket according to claim 1, wherein, the plurality of diluent spray holes is formed in at least one shape of a hole shape and a slot shape.

8. A casing body for a screening machine, a screen basket being embedded in the casing body, the casing body comprising:

a diluent pocket having a space that is configured to store a diluent introduced from the outside of the diluent pocket;

a non-acceptable raw material outlet configured to discharge a non-acceptable raw material that does not pass through an open screen surface of the screen basket; and a first casing flange located adjacent to the non-acceptable raw material outlet and coupled with a screen basket flange of the screen basket, wherein the first casing flange comprises a diluent inlet into which a diluent originating from the diluent pocket is introduced; a diluent outlet connected to the screen basket; and a diluent supply passage through which the introduced diluent is delivered to the screen basket flange, wherein the space of the diluent pocket is located at a lower part of the diluent inlet, and wherein a loop is formed along the first casing flange.

9. The casing body according to claim 8, wherein the first casing flange is an upper casing flange or a lower casing flange.

10. The casing body according to claim 8, wherein the diluent pocket is formed at a circumferential surface of an inside or outside of the casing body and the first casing flange.

11. A screening machine for screening a paper material, the screening machine comprising:

the screen basket according to claim 1; and a casing body for a screening machine comprising the screen basket embedded therein, wherein the casing body comprises a diluent pocket having a space that is configured to store a diluent introduced from the outside of the diluent pocket;

a non-acceptable raw material outlet configured to discharge a non-acceptable raw material that does not pass through an open screen surface of the screen basket; and a first casing flange located adjacent to the non-acceptable raw material outlet and coupled with a screen basket flange of the screen basket, wherein the first casing flange comprises a diluent inlet into which a diluent originating from the diluent pocket is introduced; a diluent outlet connected to the screen basket; and a diluent supply passage through which the introduced diluent is delivered to the screen basket flange, wherein the space of the diluent pocket is located at a lower part of the diluent inlet, and wherein a loop is formed along the first casing flange.

12. The screening machine according to claim 11, further comprising a sealing member for preventing leakage between the diluent outlet of the first casing flange of the casing body and the diluent inlet, connected to the diluent outlet, of the first screen basket flange of the screen basket.

13. The screening machine according to claim 11, wherein the diluent supply passage formed at the first screen basket flange of the screen basket is horizontally connected to the diluent supply passage formed at the first casing flange of the casing body.

14. The screening machine according to claim 11, wherein the first casing flange of the casing body for the screening machine is an upper casing flange or a lower casing flange.

15. The screening machine according to claim 11, wherein the diluent pocket of the casing body is formed on a circumferential surface of an inside or outside of the casing body and the first casing flange.

* * * * *